US008552930B2

(12) United States Patent
Yamamoto et al.

(10) Patent No.: US 8,552,930 B2
(45) Date of Patent: Oct. 8, 2013

(54) LIQUID CRYSTAL DISPLAY APPARATUS

(75) Inventors: Tsunenori Yamamoto, Hitachi (JP); Sukekazu Aratani, Hitachiota (JP); Makoto Yoneya, Hitachinaka (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 604 days.

(21) Appl. No.: 10/735,725

(22) Filed: Dec. 16, 2003

(65) Prior Publication Data

US 2004/0125062 A1 Jul. 1, 2004

Related U.S. Application Data

(63) Continuation of application No. 09/695,174, filed on Oct. 25, 2000, now abandoned.

(30) Foreign Application Priority Data

Oct. 25, 1999 (JP) ..... 11-303077

(51) Int. Cl.
*G09G 3/18* (2006.01)

(52) U.S. Cl.
USPC ..... 345/52; 345/53; 349/61; 349/62

(58) Field of Classification Search
USPC ..... 345/87, 89, 90, 94, 95, 98, 99, 100, 345/102; 349/61, 62, 63, 66, 68, 69, 70, 349/71

See application file for complete search history.

(56) References Cited

U.S. PATENT DOCUMENTS

| | | | | |
|---|---|---|---|---|
| 5,119,084 | A * | 6/1992 | Kawamura et al. | 345/98 |
| 5,170,271 | A * | 12/1992 | Lackner et al. | 349/25 |
| 5,457,474 | A | 10/1995 | Ikeda | |
| 5,526,012 | A | 6/1996 | Shibahara | |
| 5,528,257 | A | 6/1996 | Okumura et al. | |
| 5,592,193 | A * | 1/1997 | Chen | 345/102 |
| 5,684,503 | A * | 11/1997 | Nomura et al. | 345/97 |
| 5,724,057 | A | 3/1998 | Kimura et al. | |

(Continued)

FOREIGN PATENT DOCUMENTS

| | | |
|---|---|---|
| JP | 4-288589 | 10/1992 |
| JP | 7-121138 | 5/1995 |

OTHER PUBLICATIONS

H. Okumura, et al., "A New Low-Image-Lag Drive Method for Large-Size LCTVs", SID 92 Digest, pp. 601-604 (1992).

(Continued)

*Primary Examiner* — Amare Mengistu
*Assistant Examiner* — Vinh Lam
(74) *Attorney, Agent, or Firm* — Antonelli, Terry, Stout & Kraus, LLP.

(57) ABSTRACT

A liquid crystal display apparatus is able to display high quality motion pictures with less after-image when displaying motion pictures and with less fuzzy images without making the response speed of the liquid crystal too fast. The display data emphasized excessively more than a changed value is written into the pixel having any change detected by comparison with the previous display data and its value is made to change excessively more than the value corresponding to its original display data, and then, according to the optical response of the liquid crystal, the lighting time and the lighting period of the light source are controlled for the individual areas of the illumination unit having plural areas.

11 Claims, 9 Drawing Sheets

(56) References Cited

U.S. PATENT DOCUMENTS

| | | | | |
|---|---|---|---|---|
| 5,731,794 | A * | 3/1998 | Miyazawa | 345/88 |
| 5,734,453 | A | 3/1998 | Takemura | |
| 5,784,042 | A * | 7/1998 | Ono et al. | 345/94 |
| 5,818,407 | A | 10/1998 | Hori et al. | |
| 5,835,075 | A * | 11/1998 | Nomura et al. | 345/97 |
| 5,844,534 | A | 12/1998 | Okumura et al. | |
| 5,844,540 | A * | 12/1998 | Terasaki | 345/102 |
| 5,912,651 | A * | 6/1999 | Bitzakidis et al. | 345/58 |
| 5,920,298 | A * | 7/1999 | McKnight | 345/87 |
| 5,952,992 | A * | 9/1999 | Helms | 345/102 |
| 6,046,716 | A * | 4/2000 | McKnight | 345/95 |
| 6,078,303 | A * | 6/2000 | McKnight | 345/87 |
| 6,104,367 | A * | 8/2000 | McKnight | 345/94 |
| 6,115,018 | A * | 9/2000 | Okumura et al. | 345/95 |
| 6,144,353 | A * | 11/2000 | McKnight | 345/94 |
| 6,198,234 | B1 * | 3/2001 | Henry | 315/291 |
| 6,300,931 | B1 * | 10/2001 | Someya et al. | 345/102 |
| 6,304,254 | B1 * | 10/2001 | Johnson et al. | 345/204 |
| 6,331,844 | B1 | 12/2001 | Okumura et al. | |
| 6,388,649 | B1 * | 5/2002 | Tanaka et al. | 345/89 |
| 6,411,306 | B1 * | 6/2002 | Miller et al. | 345/690 |
| 6,414,664 | B1 * | 7/2002 | Conover et al. | 345/89 |
| 6,456,266 | B1 * | 9/2002 | Iba et al. | 345/87 |
| 6,466,225 | B1 * | 10/2002 | Larkin et al. | 345/596 |
| 6,501,451 | B1 * | 12/2002 | Sakashita | 345/87 |
| 6,661,400 | B2 * | 12/2003 | Sakashita | 345/89 |
| 6,661,470 | B1 * | 12/2003 | Kawamura et al. | 348/699 |
| 2002/0000960 | A1 * | 1/2002 | Yoshihara et al. | 345/87 |
| 2002/0057238 | A1 * | 5/2002 | Nitta et al. | 345/87 |
| 2004/0125062 | A1 * | 7/2004 | Yamamoto et al. | 345/87 |
| 2006/0181503 | A1 * | 8/2006 | Feng | 345/102 |

OTHER PUBLICATIONS

K. Sueoka, et al., "Improving the Moving-Image Quality of TFT-LCDs", IDRC'97, pp. 203-206 (1998).

* cited by examiner

LIQUID CRYSTAL DISPLAY APPARATUS

CROSS-REFERENCE TO RELATED APPLICATIONS

This application is a continuation of application Ser. No. 09/695,174 filed on Oct. 25, 2000 now abandoned. The contents of application Ser. No. 09/695,174 are hereby incorporated herein by reference in their entirety.

BACKGROUND OF THE INVENTION

The present invention relates to a liquid crystal display apparatus, and, especially, to an active matrix type liquid crystal display apparatus.

In the conventional active matrix type liquid crystal display apparatus, the method which employs nematic liquid crystals is used for all the distinctive liquid crystal display modes, such as the twisted nematic method and the horizontal electric field method. In the liquid crystal display apparatus using nematic liquid crystals, the liquid crystal responds to a voltage change with a relatively slow response time of from 15 msec to 50 msec for altering the display image from black to white or from white to black. The response time for altering the display image from white to a middle tone or from black to a middle tone is even slower, such as 40 msec to 150 msec, which may lead to after images, which appear like brushed pictures, in case of displaying motion pictures containing middle tone components, such as television pictures.

The display method in those conventional liquid crystal display apparatuses is called a "hold type" method in which an identical image is continuously presented during a single frame defined as a single cycle of the image signal.

In displaying motion pictures like television pictures with this hold type liquid crystal display apparatus, a moving object in a series of images to be animated continuously is displayed at a fixed position in a single frame. This means that the moving object is displayed at a proper position in a time slot within the single frame, but this moving object is displayed at an unexpected position and an unexpected image is displayed at the proper position at another time slot. The human sight recognizes those images as equalized images, which leads to fuzzy images.

As described above, there are two problems in displaying motion pictures using a liquid crystal display apparatus. As for the first problem, H. Okumura et al. "SID 92 DIGEST p.601 (1992)" and Japanese Patent Application Laid-Open No. 4-288589 (1992) disclose a technology in which the picture signal in the present frame supplied from the picture source is compared with the picture signal in the previous frame; and, in case any change in the picture signal is detected, the picture signal is emphasized and converted in order to enhance the change in the picture signal, whereby the display at the corresponding pixel is adjusted to a value corresponding to the desired picture signal until the next frame begins.

As for the second problem, K. Sueoka et al. "IDRC '97 PP.203 (1998)" discloses a technology in which the generation of fuzzy images due to the equalization operation is prevented by means whereby the liquid crystal is made to respond at first by scanning the whole liquid crystal panel, and next the illumination unit is turned on.

In the prior art described above in connection with the first problem, however, though the response with respect to the middle tone can be made faster by means of the image emphasis and conversion operation, since the display response for the individual pixel reaches a designated display result at the end of the single frame period (about 16.6 msec), there is still a problem in that the display result provided during this period may be recognized as after images.

In the prior art described above in connection with the second problem, however, since the illumination unit is turned on after the data has been written by scanning all the pixels in the liquid crystal display part and all the pixels respond completely, the scanning time and the response time of the liquid crystal should be required to be made extremely short. In addition, since the lighting time period of the illumination unit is short, its light intensity should be increased in order to establish a brightness equivalent to that in the prior art. For this reason, there is a problem in that the electric current supplied to the illumination unit increases and the lifetime of the illumination unit itself becomes shorter.

In attempting to combine advantageous aspects of the above-described known techniques, since it takes long time using the second prior art technique described above to scan all the pixels and write the data, the first prior art technique can not attain the required response time by itself, and thus, there is a problem in that the response time of the liquid crystal itself should be made much faster.

Otherwise, in case the first prior art technique is used for establishing enough response and then the second prior art technique is used for lighting the illumination unit, since the lighting time period of the illumination unit becomes extremely short, there is a problem in that the lifetime of the illumination unit becomes shorter because it is required to increase the amount of electric current to be supplied to the illumination unit.

SUMMARY OF THE INVENTION

An object of the present invention is to solve the difficulties and problems related to the prior art, as described above, and to provide an active matrix type liquid crystal display apparatus which makes it possible to display high quality motion pictures with less after image when displaying motion pictures and with less fuzzy images due to equalization.

In accordance with the present invention, in order to attain the above object, a liquid crystal display apparatus has a pair of substrates, at least one of which is transparent; a liquid crystal layer is supported between said pair of substrates; and on at least one of said pair of substrates, plural groups of electrodes are provided for applying an electric field to said liquid crystal layer. A liquid crystal display part having plural active elements is connected to those electrodes; a drive means is provided with display data from means for supplying data to be displayed and for driving the individual pixels of said liquid crystal display part by applying a voltage corresponding to the display data; and plural light sources are provided.

In accordance with the invention, the drive means comprises a data emphasis means for comparing new display data supplied from the means for supplying data to be displayed with previous display data and for emphasizing and converting the display data into designated display data in response to the comparison result; and an illumination control means for controlling the lighting timing and lighting period of the light source for the individual areas of the illumination unit in accordance with the response of the liquid crystal display part after data emphasis.

According to another feature of the present invention, in case any change is detected in the display data by the comparison, the data emphasis means emphasizes and converts the display data so as to increase its change, and modifies the response of the corresponding pixel of the liquid crystal display part so as to be larger than the value corresponding to the original display data. The illumination control means controls the lighting timing and the lighting period of the light source of the illumination unit so that the time integral values of the amount of light passing through the corresponding pixel may be identical to each other.

According to another feature of the present invention, the liquid crystal display apparatus comprises a liquid crystal display part for displaying a picture signal, a drive means for driving the liquid crystal display part, at least one light source, a light amount adjusting part for adjusting the light from the light source for an individual area, in which the drive means has a picture signal emphasis means for comparing a new picture signal, supplied from the means for supplying the picture signal, with a previous picture signal, and emphasizing and converting the picture signal in response to the comparison result, and an illumination control means for controlling the light amount adjusting means of the illumination unit in response to the display contents of the liquid crystal display part for displaying the picture signal after the emphasis and conversion operations.

According to another feature of the present invention, the illumination control means is allowed to control the lighting timing and the lighting period of the light source of the illumination unit so that the visual sensation values with respect to the light passing through the corresponding pixel in the course of the response and after the response may be almost identical to each other.

The light source of the illumination unit may be composed of a sheet-type light emitting element.

DETAILED DESCRIPTION OF THE PREFERRED EMBODIMENTS

The present invention will be described in detail with reference to various embodiments.

[Embodiment 1]

Figure 1:
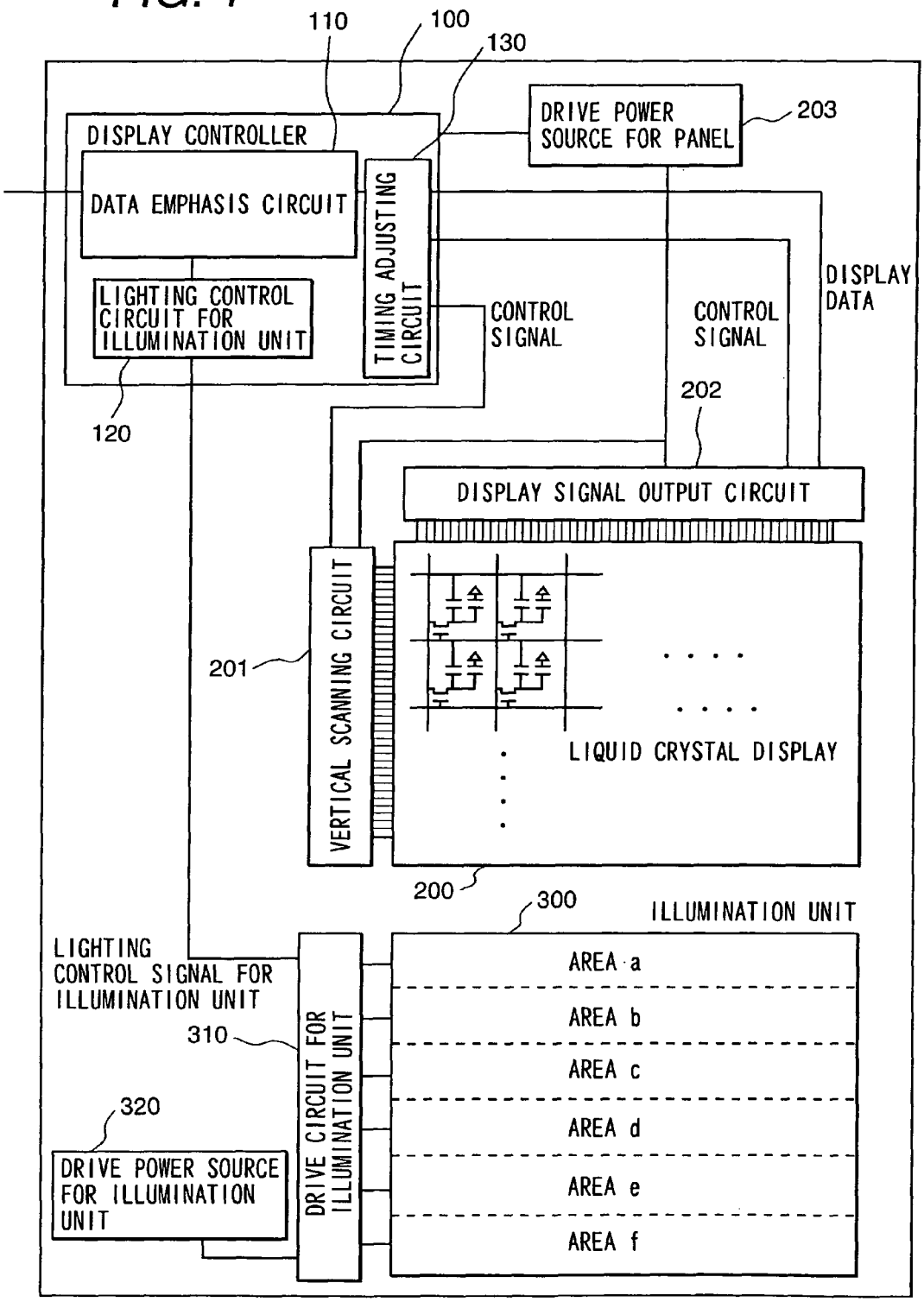
FIG. 1 is a block diagram of a liquid crystal display apparatus representing an embodiment 1 of the present invention.

FIG. 1 shows a block diagram of the liquid crystal display apparatus in accordance with this embodiment. The liquid crystal display apparatus is composed of a display controller 100, a liquid crystal display part 200, a vertical scanning circuit 201, a display signal output circuit 202, a panel drive power circuit 203, an illumination unit 300, a drive circuit 310 for the illumination unit 300 and a drive power source for the illumination unit 320. The display data is supplied to the display controller 100 (drive means) from the means for supplying data to be displayed, and the individual pixels at the liquid crystal display part are driven by an applied voltage corresponding to the display data. The liquid crystal display part 200 has a pair of substrates, at least one of which is formed to be transparent, a liquid crystal layer supported between said substrates, plural groups of electrodes for applying electric fields to said liquid crystal layer on at least one of said substrates, and plural active devices connected to those electrodes for forming pixels. The illumination unit 300 is partitioned into plural areas, each of which has its own light source corresponding to the individual area.

In this configuration, the liquid crystal display part 200 is placed above the illumination unit 300, and the drive circuit 310 for the illumination unit 300 is established at the illumination unit 300 for controlling the illumination timing and its duration time for the individual areas. Its structure will be described below.

Figure 2:
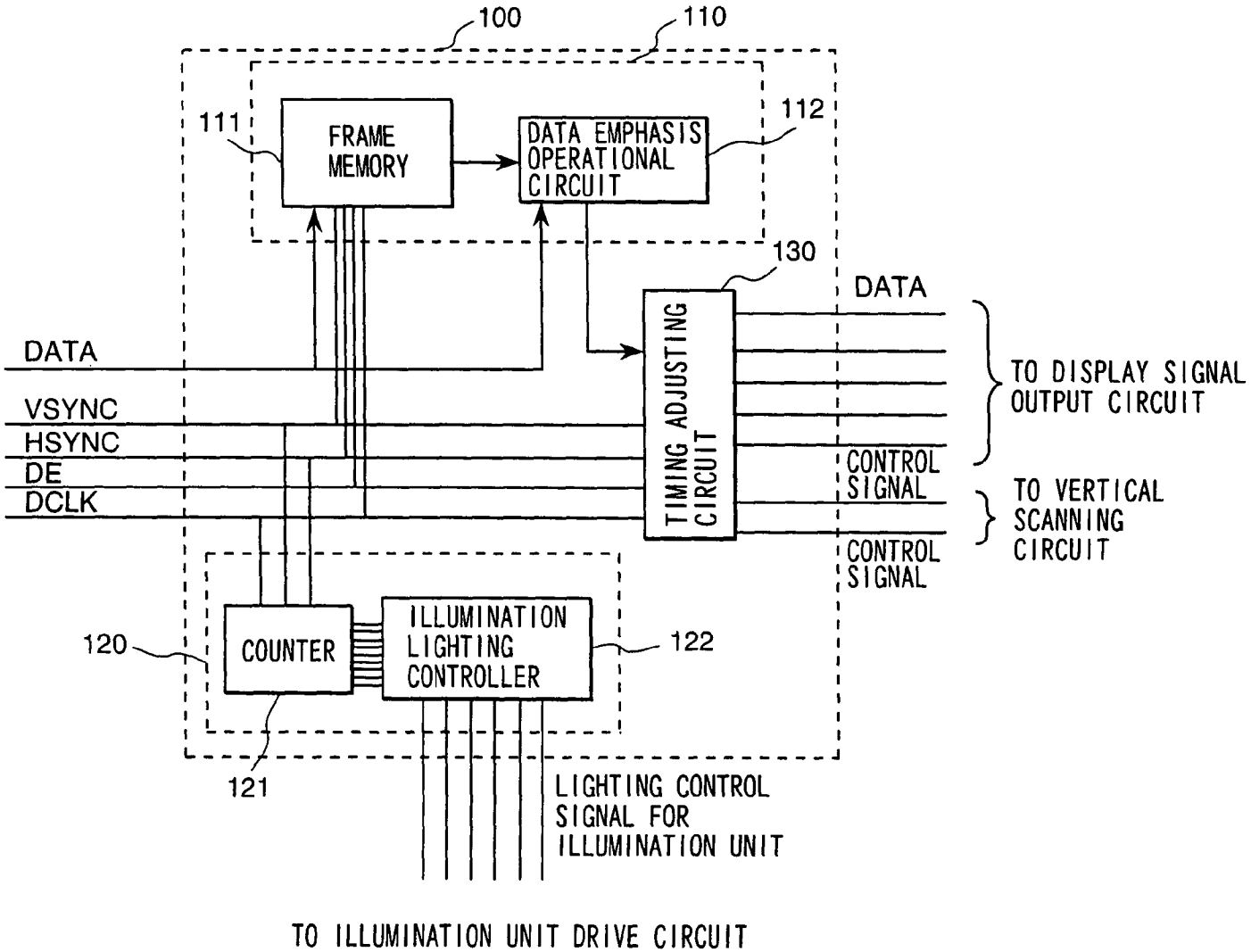
FIG. 2 is a block diagram of the display controller in the embodiment 1.

As shown in FIG. 1, the display controller 100 is mainly composed of a data emphasis means, that is, a data emphasis circuit 110, a lighting control circuit 120 for the illumination unit 300, and a timing adjusting circuit 130. A more detailed block diagram of the display controller 100 is shown in FIG. 2. The image data supplied from the image signal source is stored into a frame memory 111 and compared with the image data of the previous frame stored in the frame memory 111 pixel by pixel using the data emphasis operational circuit 112. In case a difference between the previous image data and the present image data is detected, the data will be emphasized (emphasized normally or excessively) so that the difference is increased, and its timing is adjusted by the timing adjusting circuit 130, and then the adjusted data is transferred to the liquid crystal display part 200. With this configuration and operation, the liquid crystal response at an individual pixel is made faster especially at an intermediate gradation in comparison to the case without data emphasis, and a display image equivalent to the original image data can be displayed at a single frame duration time (about 16.6 msec.)

The distinguished difference in the embodiment 1 from the prior art is that, though the data is emphasized after a single frame period so as to provide a display image equivalent to the original image data in the prior art, that is, what is called an overdrive drive, the data is emphasized excessively in accordance with the present invention so that the data may change more than the display image corresponding to the original image data after a single frame period.

Figure 3:
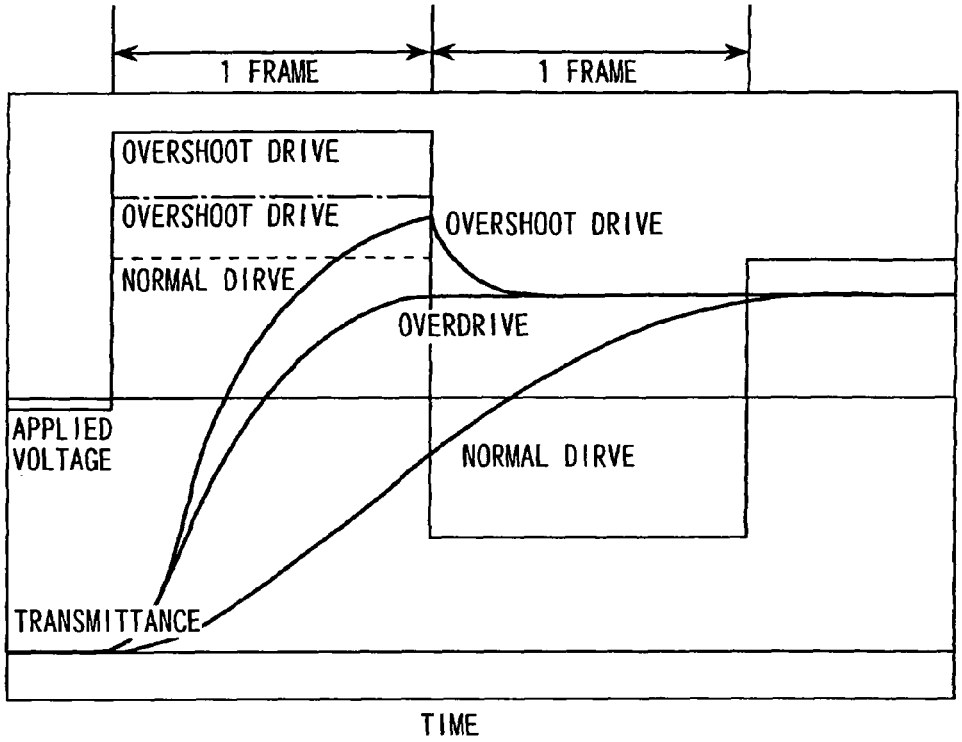
FIG. 3 is a graph showing the relations between transmission factors and time for the overdrive drive operation and the overshoot driver operation.

An example is shown in FIG. 3. In the overdrive drive technology in the prior art, a voltage higher than the voltage with which the panel is driven normally is applied by means which causes the data to be emphasized moderately and converted with indices such as 0, 75 and 50, and then, a designated display characteristic (transmission factor) can be reached within a single frame period (about 16.6 msec.) In this case, the transmission factor, which increases as the overdrive drive operation, is controlled so that its value may not exceed the maximum value of the transmission factor for the normal state.

In contrast, in the embodiment 1 of the present invention, the data is emphasized excessively with indices such as 0, 85 and 50 so that a higher voltage may be applied, and then, an overshoot drive is performed so that a display characteristic (transmission factor) which exceeds the designated level may be reached within a single frame period. In other words, at the time of overshoot drive, the value of the transmission factor is controlled so as to exceed the maximum value of the transmission factor for the normal state.

Figure 4:
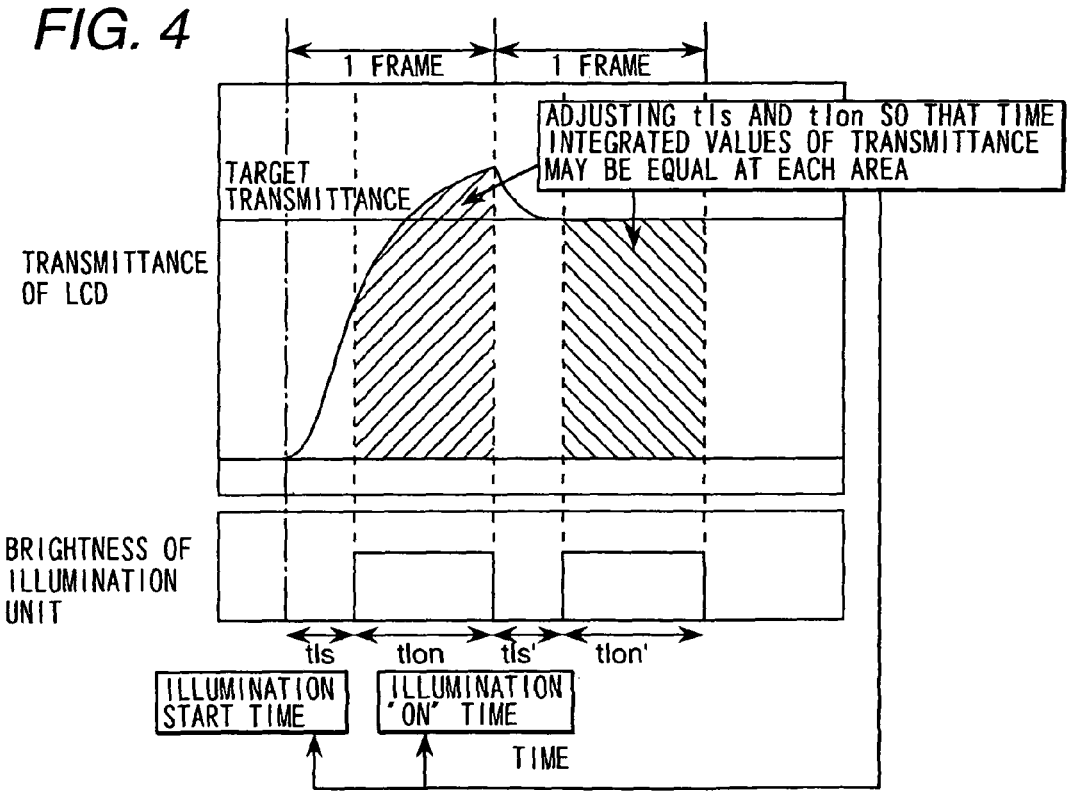
FIG. 4 is a timing diagram illustrating the method of control of the illumination start time and the illumination "on" time in embodiment 1.

Next, by referring to FIG. 4, the operation of the lighting control circuit 120 for the illumination unit 300 as an illumination control means in the display controller 100 will be described. The excessive data emphasis operation as described above is performed, and the illumination lighting controller 122 in the lighting control circuit 120 for the illumination unit 300 controls the illumination start time and the illumination "on" time of the illumination unit by referring to the counter data supplied from the counter 121 managing the single frame time period with the control signal from the image signal source, so that the time integral value of the transmission factor for the frame in which the display characteristic (transmission factor) changes due to the overshoot drive may be almost equal to the time integral value of the transmission factor for the frame in which the display characteristic (transmission factor) reaches a designated level and stays in a stable state.

In case that the illumination "on" time is identical for the individual frames, the above described control is enabled when the value of the transmission factor by the overshoot drive operation exceeds the maximum value of the transmission factor at the normal state. In other words, for such a case as the overdrive drive operation in which the value of the transmission factor does not exceed the maximum value of the transmission factor at the normal state, when the illumination "on" time is identical, it is not impossible to control both time integral values so they are almost identical to each other.

As for the actual lighting control method, for example, the time-dependent characteristic of the brightness of the liquid crystal display apparatus is measured by a luminance meter, and then, the data emphasis circuit 110 and the lighting control circuit 120 for the illumination unit 300 may be controlled so that the time integral values may be identical to each other. As for the lighting control method, it is allowed to control the value of the electric current instead of controlling the length of the illumination "on" time.

Since the time integral value of the brightness can be detected in the human characteristic related to a visual sensation, by means in which the display images are established by controlling the time integral values of the transmission factor so as to be identical to each other, the display image when changing itself due to the overshoot drive operation and the display image when the designated display level is reached and its stable image is displayed are recognized as an almost identical image. This means that there is almost no after image.

That the time integral value of the transmission factor at the overshoot drive operation is almost identical to that when the stable display image is established means that a display image equivalent to that obtained after responding sufficiently to the incident signals can be obtained, which also leads to a reduction of the after images due to the equalization operation in a similar manner to the prior art.

In this embodiment, the illumination start time and the illumination "on" time for the different frames are identical to one another. Though the illumination start time and the illumination "on" time satisfying the condition that the time integral value of the transmission factor at the overshoot drive operation is almost equal to that at the stable state is slightly subject to the number of gradations to be displayed, the illumination start time and the illumination "on" time are adjusted so as to be equal to the average values of the optimum values for all the individual gradations to be covered.

The illumination start time and the illumination "on" time for an individual pixel in the liquid crystal display part 200 are defined relative to the elapsed time after the voltage is applied to the individual pixels. As the image display operation for the liquid crystal display part 200 is performed by scanning from the upper part to the lower part, the display timing for the upper part is different from that for the lower part in the time period for a single frame. For this reason, identical values for the illumination start time and the illumination "on" time could not be defined equally for the upper part and the lower part by lighting all of the areas in the liquid crystal display part 200 with a single illumination unit.

Figure 5:
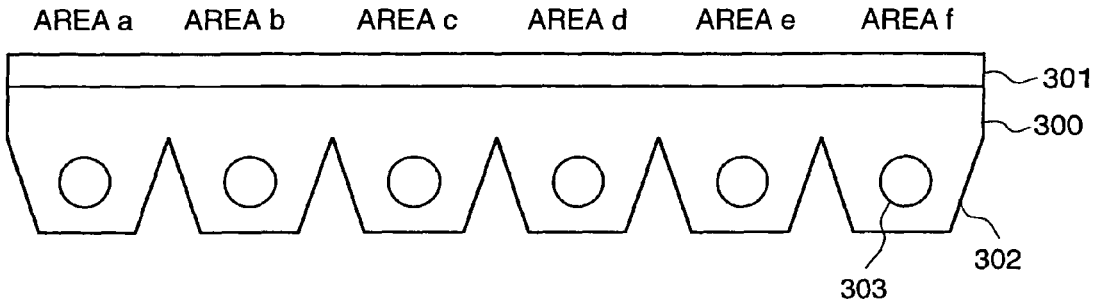
FIG. 5 is a cross-sectional view of the illumination unit in embodiment 1.

In this embodiment, the illumination unit 300 located below the liquid crystal display part 200 is partitioned into six areas (areas a to f) from the upper part to the lower part. The cross-sectional view of the illumination unit 300 is shown in FIG. 5.

The illumination unit 300 has a structure in which a single fluorescent tube 303 is arranged for the individual areas "a" to "f", and there is a scattering and reflection panel 302 enclosing the fluorescent tubes, and a scattering panel 301 covers the scattering and reflecting panel.

Figure 6:
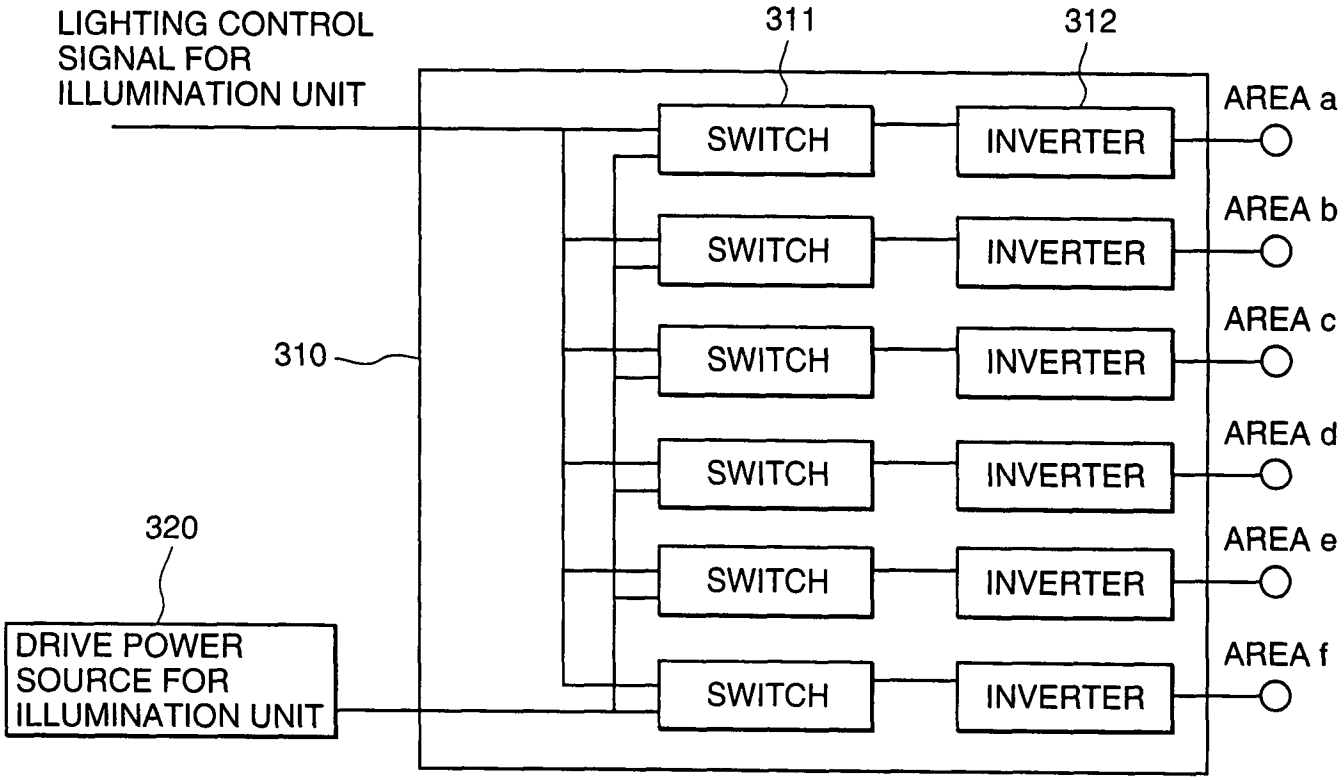
FIG. 6 is a block diagram of the drive circuit for the illumination unit in embodiment 1.

A detail view of the drive circuit 310 for driving the illumination unit 300 is shown in FIG. 6. In the drive circuit 310 for the illumination unit 300, there are inverters 312 and illumination unit area switches 311 for the individual areas in order to light the individual areas separately with this fluorescent tubes for the individual areas in the illumination unit 300. With those components, the drive circuit 310 for the illumination unit 300 can light the individual areas with their own different illumination start time and illumination "on" time in response to a control signal supplied from the display controller 110.

Figure 7:
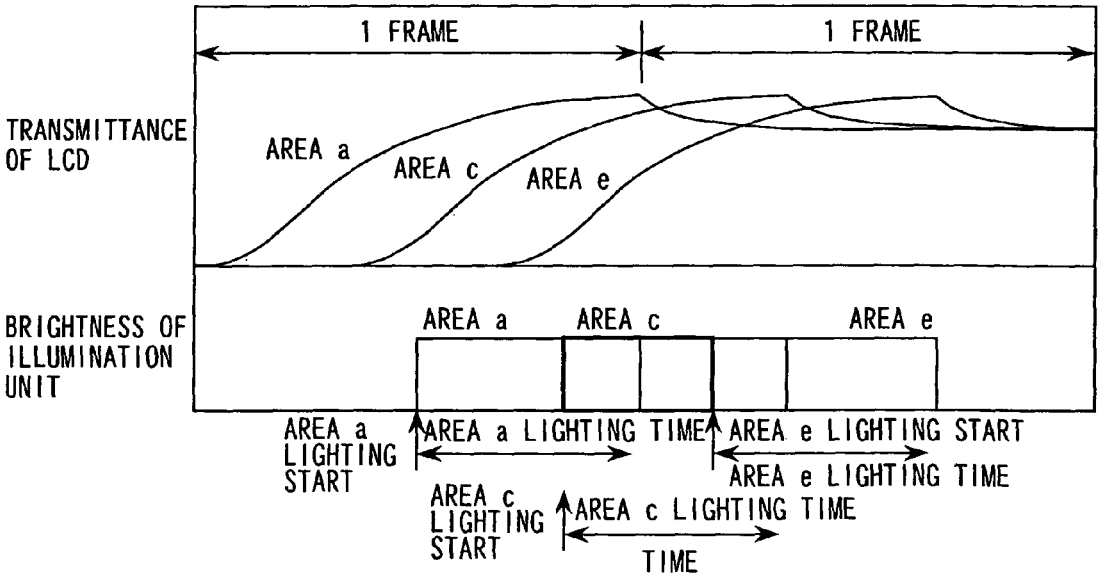
FIG. 7 is a diagram showing time trends in the transmittance and the brightness of the illumination unit at the individual area of the liquid crystal display apparatus in embodiment 1.

The time trends in the display characteristic (transmission factor) and the illumination operation for the several areas (areas "a", "c" and "e") are shown in FIG. 7. As the data emphasized excessively immediately after the start of a single frame period is written in the upper most area "a" in the liquid crystal display part 200, the transmission factor rises up immediately. And then, when the transmission factor reaches a certain level, the illumination for the area "a" is produced. Along with this process, the transmission factor for the intermediate area "c" rises up in response to the data emphasized excessively as written into the intermediate area "c" in the liquid crystal display part 200, and then, the illumination for the area "c" is produced when its transmission factor reaches a certain level. Finally, the transmission factor for the area "e" rises up in response to the data emphasized excessively as written into the upper lower area "e" in the liquid crystal display part 200, and then its illumination is produced. Though not shown in FIG. 7, as for the areas "b", "d" and "f", their transmission factors rise up in response to their data emphasized excessively, and then, their illuminations are produced.

Though the illumination for the area "e" is produced after the lighting period for the area "a" terminates and it appears to continue to illuminate at the next frame period, as the data in the previous frame is displayed on the area "e", there is not problem in displaying normal images even if the response of the liquid crystal is slow. In addition, since the illumination unit 300 is separated into six areas, and their lighting time does not become extremely short, there is no increase in the electric current for greatly increasing the light intensity for the illumination operation, and therefore, the lifetime of the illumination unit is not shortened.

In displaying motion pictures with the liquid crystal display apparatus of this embodiment as described above, high quality motion pictures can be obtained without after images and fuzzy images due to equalization.

So far, in this embodiment, since an overshoot drive is used in which the data is emphasized and converted excessively, an active matrix type liquid crystal display apparatus which is able to display high quality motion pictures with less after images and fuzzy images due to equalization when displaying motion pictures can be provided without extremely reducing the response speed of the liquid crystal, and without reducing the lifetime of the illumination unit.

[Embodiment 2]

Figure 8:
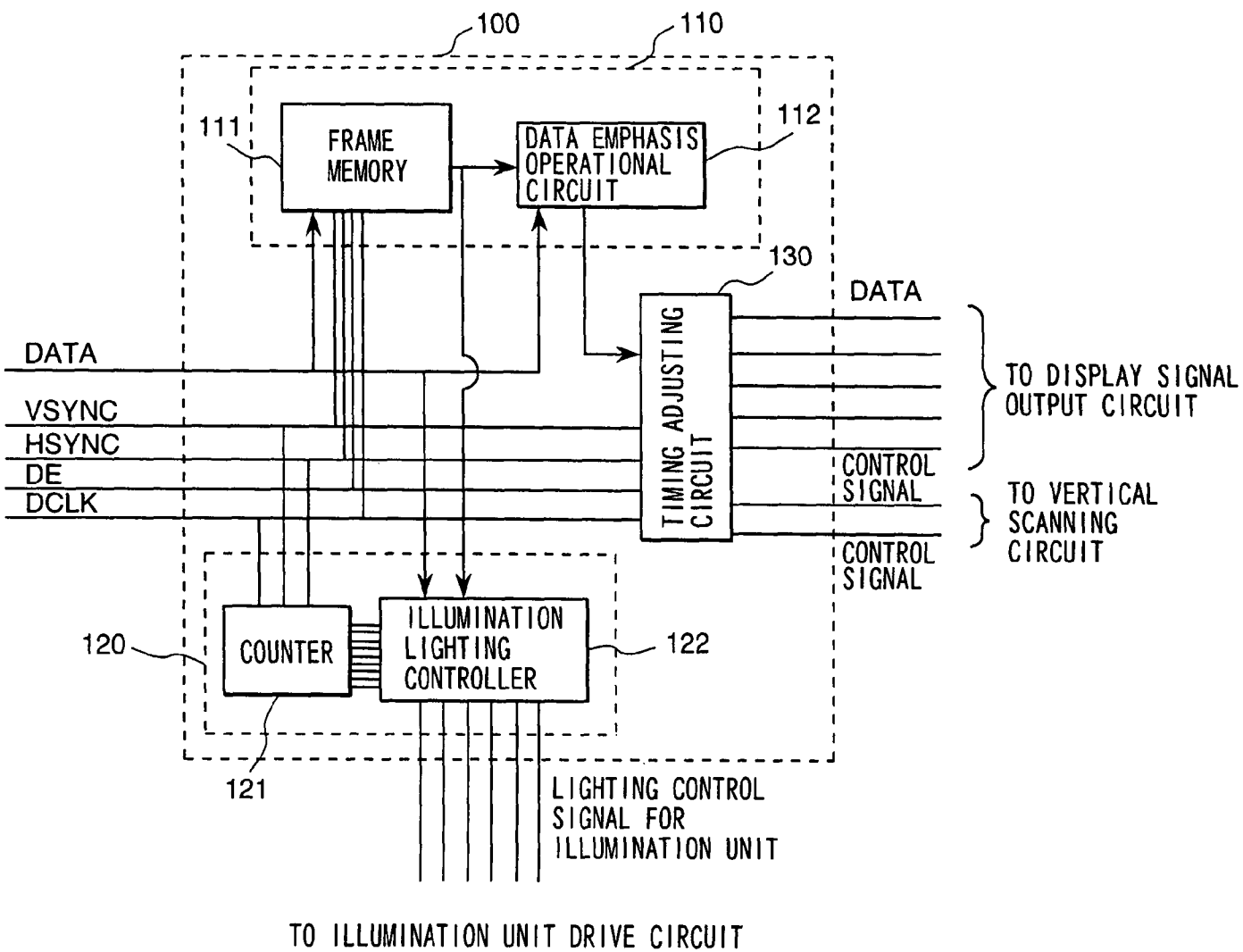
FIG. 8 is a block diagram of the display controller in an embodiment 2 of the present invention.

A block diagram of the display controller 100 in this embodiment is shown in FIG. 8. Like the embodiment 1, the display controller 100 (drive means) is composed of a data emphasis circuit 110, a lighting control circuit 120 for the illumination unit 300, an illumination lighting controller 122 and a timing adjusting circuit 130.

In this embodiment, it is common to the embodiment 1 that the illumination lighting controller 122 as the illumination control means controls the illumination start time and the illumination "on" time of the illumination unit so that the time integral value of the transmission factor for the frame in which the display characteristic (transmission factor) changes due to the overshoot drive may be almost equal to the time integral value of the transmission factor for the frame in which the display characteristic (transmission factor) reaches a designated level and stays in a stable state. On the other hand, unlike embodiment 1 in which the illumination start time and the illumination "on" time are adjusted so as to be equal to the average values of the optimum values for all the individual gradations to be covered, the average value of the individual gradation weighted with the number of pixels displayed for the individual areas is estimated in real time, and the illumination start time and the illumination "on" time are controlled adaptively. For this reason, the image data is supplied to the illumination lighting controller 122 in FIG. 8.

Thus, by means in which the illumination start time and the illumination "on" time are made to change in response to the display data, the time integral value of the transmission factor for the frame in which the transmission factor changes due to the overshoot drive can be precisely identical to the time integral value of the transmission factor for the frame in which the transmission factor reaches a designated level and stays in a stable state at the individual areas in the liquid crystal display part 200, and, therefore, the after images and the fuzzy images due to equalization are put in a lower profile.

According to the above description, in this embodiment, what can be obtained is an active matrix type liquid crystal display apparatus that is able to display motion pictures with less after image and with less fuzzy images due to equalization than the case of the embodiment 1.

[Embodiment 3]

Figure 9:
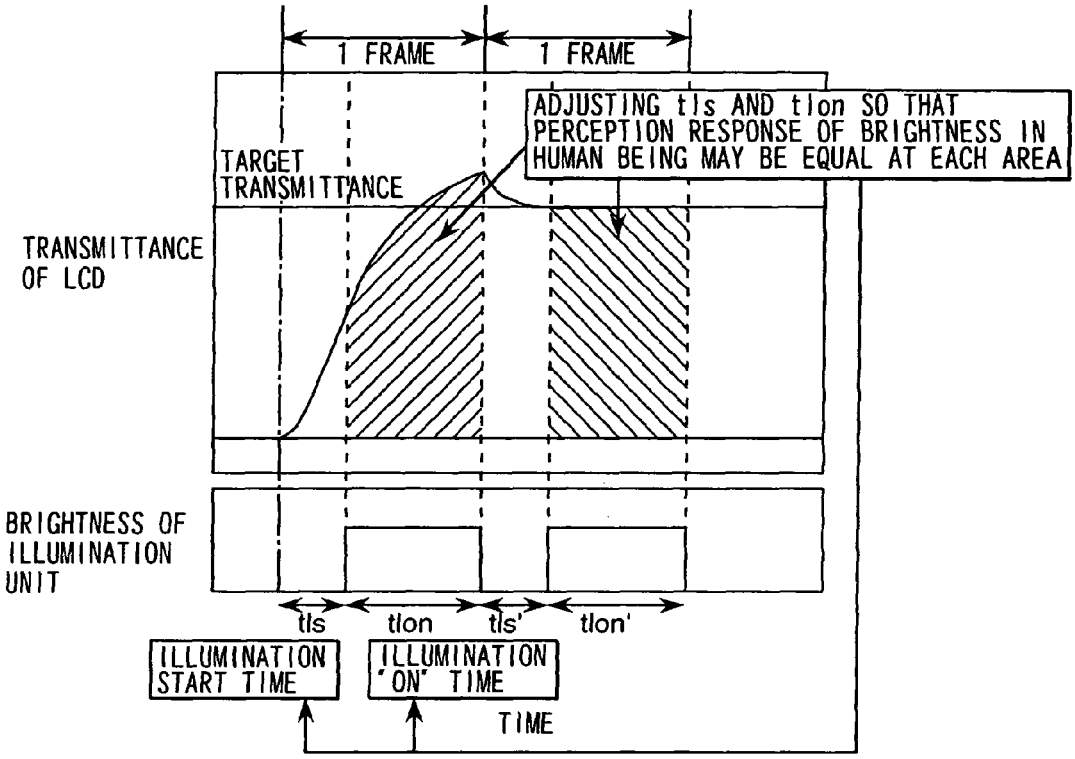
FIG. 9 is a timing diagram illustrating the method of control of the illumination start time and the illumination "on" time in an embodiment 3 of the present invention.

This embodiment has almost the same structure as the embodiment 2. On the other hand, rather than have the illumination lighting controller 122 as the illumination control means control the illumination start time and the illumination "on" time of the illumination unit so that the time integral value of the transmission factor for the frame in which the display characteristic (transmission factor) changes due to the overshoot drive may be almost equal to the time integral value of the transmission factor for the frame in which the display characteristic (transmission factor) reaches a designated level and stays in a stable state, this embodiment has a difference from the embodiment 2 in that the illumination start time and the illumination "on" time are defined so that the transmission factor at the individual frame may be identical with respect to the human brightness sensation characteristic. The operation of the lighting control circuit 120 for the illumination unit 300 in the display controller 100 is shown in FIG. 9.

As described above, though the time integral value of the brightness can be detected in the human characteristic related to a visual sensation, the human response characteristic for recognizing the brightness perceptibly is not limited to this case, but there may be a case in which a great amount of brightness more than its time integral value will be recognized in case any extreme peak in light amount occurs momentarily.

In this case, the illumination start time and the illumination "on" time may be controlled so that the time integral values of the value obtained by multiplying a certain coefficient and the brightness are identical to each other for the frame with the overshoot drive operation and the frame reaching a stable state.

Even in the case where the brightness of the liquid crystal display part exceeds momentarily the target transmission factor with the overshoot drive operation as in this embodiment, this embodiment can be applied effectively. Such a case, wherein the characteristic of the liquid crystal display part 200 responds sensitively to the input like voltage, corresponds to this one. In this case, rather than controlling illumination start time and the illumination "on" time so that the time integral values of the transmission factor at the individual frames may be identical to each other for the frame with the overshoot drive operation and the frame reaching a stable state, the after images and the fuzzy images due to equalization can be made less recognizable in the control so as to make the brightness sensation responses identical to each other.

In this embodiment, as described above, a liquid crystal display apparatus that contributes to less after images when displaying motion pictures and less fuzzy images due to equalization in comparison with the embodiment 2 for some reason related to the characteristic of the liquid crystal display part can be obtained.

Though the illumination start time and the illumination "on" time are controlled dynamically in this embodiment as in the embodiment 2, it is found that such an effect as having a certain level can be obtained by controlling with predefined constant values for the sake of simplicity as in the embodiment 1.

[Embodiment 4]

Figure 10:
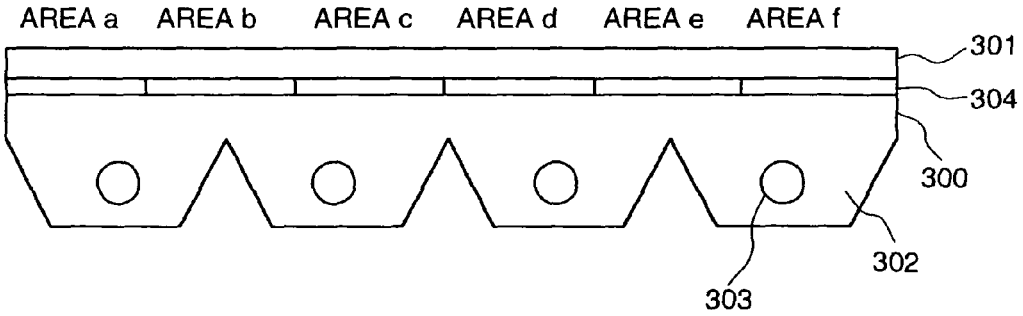
FIG. 10 is a cross-sectional view of the illumination unit in an embodiment 4 of the present invention.
Figure 11:
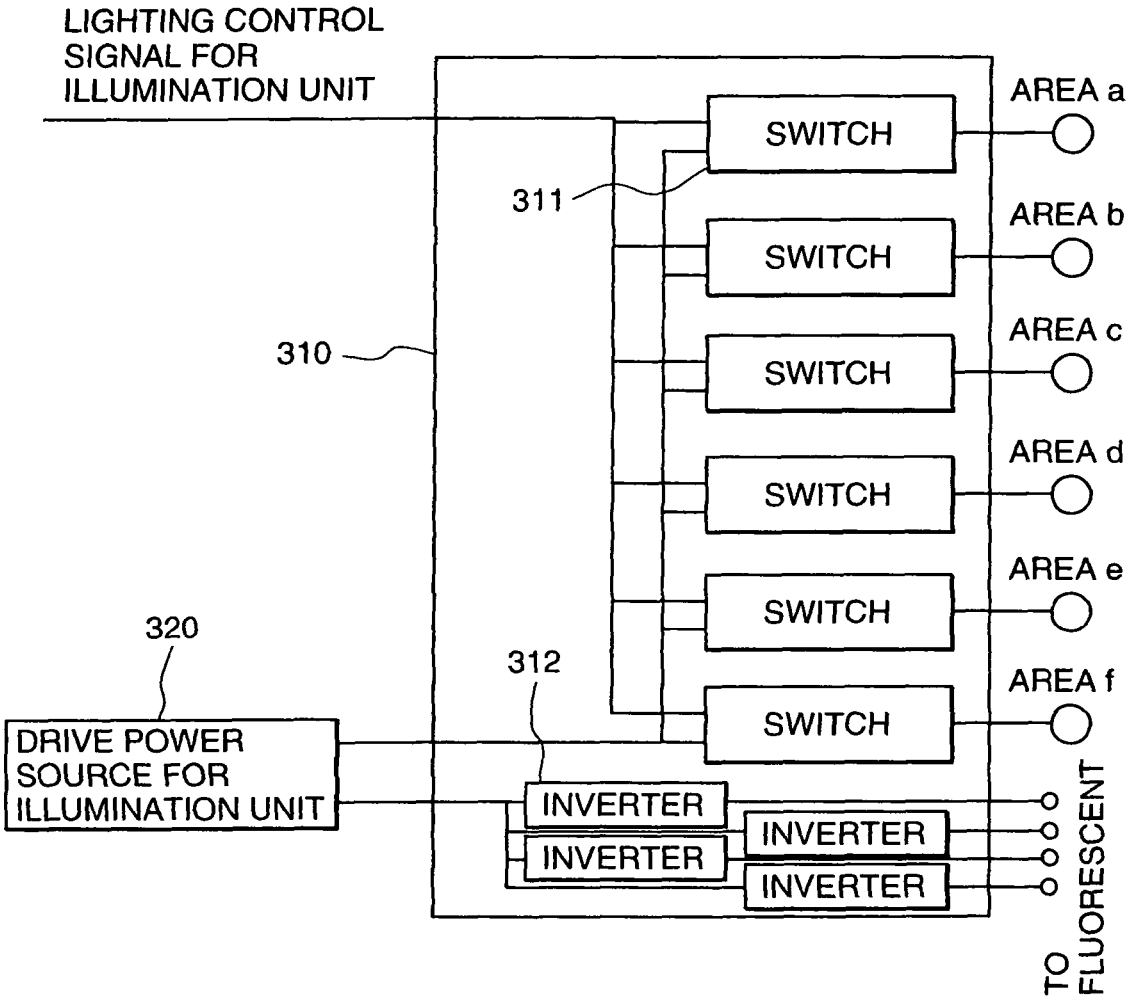
FIG. 11 is a block diagram of the drive circuit for the illumination unit in embodiment 4.

The cross-sectional view of the illumination unit 300 as the illumination control means in this embodiment is shown in FIG. 10, and the drive circuit 310 for the illumination unit 300 in this embodiment is shown in FIG. 11. This embodiment is substantially similar to the embodiment 3 in the sense that the illumination unit 300 is partitioned into six separated areas, in which the fluorescent tubes 303 and the shutters 304 between the scattering and reflection panel 302 and the scattering panel 301 are arranged with a planar geometry and six areas are formed. In this case, since the light control, such as the illumination start time and the illumination "on" time for the individual area, is controlled by the light shielding function of the shutter 304, it is possible for the number of the fluorescent tubes to be not necessarily equal to the number of areas, so that, the number of fluorescent tubes in this example is defined to be four. For the same reason, since it is not required for the fluorescent tube 303 to flash on and off alternately, the fluorescent tube can be continuously turned on, and therefore, the lifetime of the fluorescent tube 303 can be extended. The shutter 304 is composed of a liquid crystal panel using a high dielectric polymer, and it is connected to the drive circuit 310 for the illumination unit 300 as shown in FIG. 11.

Since the shutter 304 is driven with a DC voltage, the output of the illumination unit area switch 311 is directly connected to the shutter 304 for the individual area of the liquid crystal panel in the structure of the drive circuit 310 for the illumination unit 300 in FIG. 11, and the inverter 312 for driving the fluorescent tube 303 is formed as an independent system. When the voltage from the illumination unit area switch 311 is applied to the individual areas in the shutters 304, they are switched to the transmission mode, which enables the light from the fluorescent tube 303 to reach the corresponding part of the liquid crystal display part 200. This makes it possible to control the illumination start time and the illumination "on" time for the individual area of the liquid crystal display part 200.

In this embodiment, as described above, a liquid crystal display apparatus that contributes to further extension of the lifetime of the fluorescent tube 303 and less after images when displaying motion pictures and less fuzzy images due to equalization in the similar manner to the embodiment 3 can be obtained.

Though the illumination start time and the illumination "on" time are controlled so that the brightness sensation responses may be identical to each other in this embodiment, as in the embodiment 3, for some reason related to the characteristic of the liquid crystal display part, it is possible to effect control so that the time integral values of the transmission factor may be identical to each other as in the embodiment 2. Though the illumination start time and the illumination "on" time are controlled dynamically in this embodiment, as in the embodiment 2, it is found that such an effect as having a certain level can be obtained by controlling with predefined constant values for the sake of simplicity as in the embodiment 1.

[Embodiment 5]

Figure 12:
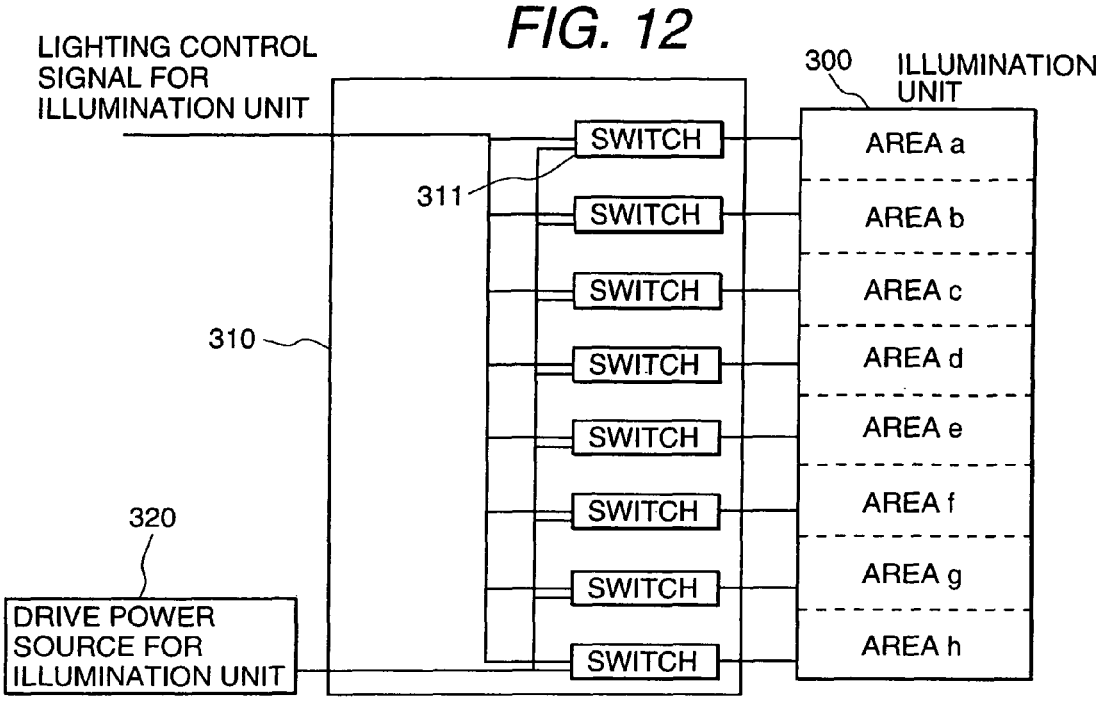
FIG. 12 is a block diagram of the illumination unit and the drive circuit of the illumination unit in an embodiment 5 of the present invention.

This embodiment has almost the same structure as the embodiment 4. The structure of the illumination unit 300 as the illumination control means characterizing this embodiment and the drive circuit 310 for the illumination unit 300 is shown in FIG. 12.

In this embodiment, a sheet-type light emitting element is used for the illumination unit 300, and its number of partitioned areas is 8 (areas "a" to "h"). The individual areas are connected to the illumination unit area switch 311 in the drive circuit 310 for the illumination unit 300, which allows the lighting control to turn on and off the light independently for the individual areas. Though an EL device (electroluminescent device) is used for the sheet-type light emitting element in this embodiment, it may be permitted to use a sheet-type fluorescent tube or an LED. By using a sheet-type light emitting element and a structure in which a shutter 304 is placed on the fluorescent tube 303 as in the embodiment 4, the number of partitioned areas in the illumination unit 303 can be defined to be different from the number of fluorescent tubes 303.

As described earlier, the illumination start time and the illumination "on" time are defined as elapsed time after the voltage is applied to the individual pixels, which depend upon the location, that is, upper parts or lower parts, in the individual areas of the illumination unit 300, and hence, the length of the individual area in the vertical direction should be preferably as short as possible. This means that the number of partitioned areas should be defined to be as many as possible. As described before, as the number of partitioned areas can be defined independently upon the number of fluorescent tubes 303 in this embodiment or the embodiment 4, the number of partitioned areas can be increased. For this reason, since the illumination start time and the illumination "on" time can be controlled with a high degree of accuracy, it will be appreciated that such a liquid crystal display apparatus with even less after images and less fuzzy images due to equalization can be provided. As the number of partitioned areas of the illumination unit 300 is defined to be 8 in this embodiment, such a liquid crystal display apparatus having even less after images and less fuzzy images due to equalization of motion pictures can be provided.

According to what is mentioned above, such a liquid crystal display apparatus with less after images when displaying motion pictures and less fuzzy images due to equalization can be obtained by increasing the number of partitioned areas of the illumination apparatus 300.

Though the illumination start time and the illumination "on" time are controlled so that the brightness sensation responses may be identical to each other in this embodiment, as in the embodiment 3, for some reason related to the characteristic of the liquid crystal display part, it is possible to effect control so that the time integral values of the transmission factor may be identical to each other, as in the embodiment 2. Though the illumination start time and the illumination "on" time are controlled dynamically in this embodiment, as in the embodiment 2, it has been found that such an effect as having a certain level can be obtained by controlling with predefined constant values for the sake of simplicity as in the embodiment 1.

[Embodiment 6]

Figure 13:
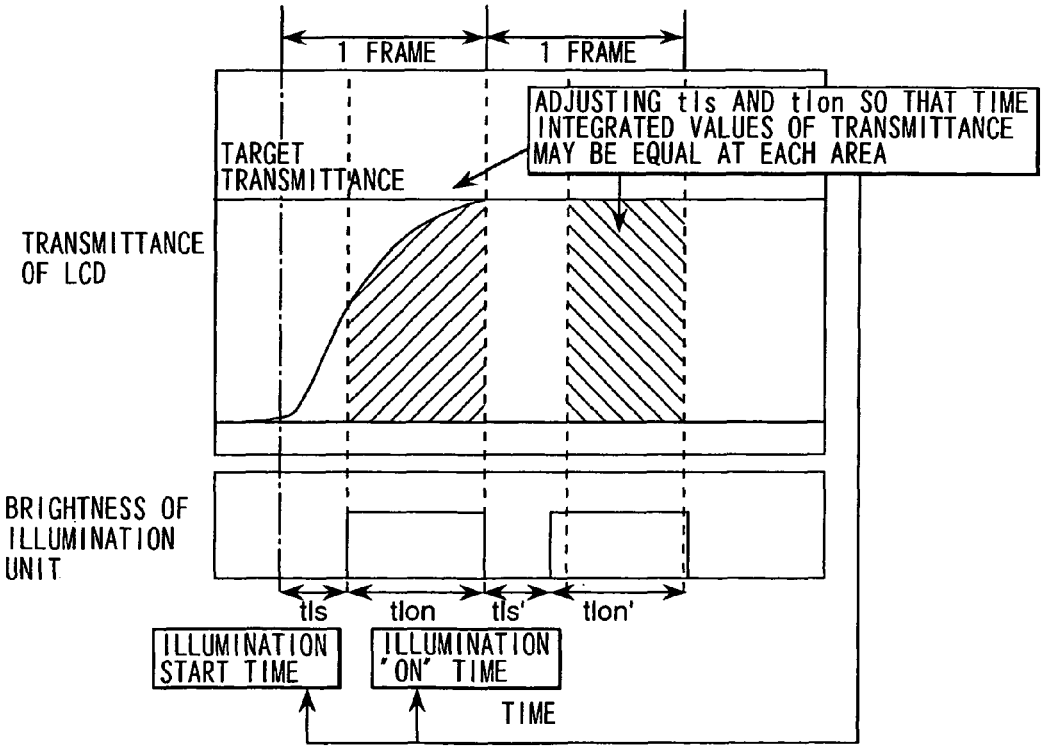
FIG. 13 is a timing diagram illustrating the method of control of the illumination start time and the illumination "on" time in an embodiment 6 of the present invention.

This embodiment has almost the same structure as the embodiment 2. However, unlike the above-mentioned embodiments, the data emphasis circuit 110 emphasizes and converts the data for the overdrive drive operation, and the illumination lighting controller 122 controls the illumination start time and the illumination "on" time of the illumination unit so that the time integral value of the transmission factor for the frame in which the display characteristic (transmission factor) changes due to the overshoot drive may be almost equal to the time integral value of the transmission factor for the frame in which the display characteristic (transmission factor) reaches a designated level and stays in a stable state. The operation of the lighting control circuit 120 for the illumination unit 300 in the display controller 100 is shown in FIG. 13.

In this embodiment, it will be appreciated that the after images and the fuzzy images due to equalization can be made less recognizable even by controlling with an overdrive drive operation so that the time integral values of the transmission factor may be identical to each other.

According to the present invention, by using the above-mentioned structure, it will be appreciated that an active matrix type liquid crystal display apparatus which makes it possible to display motion pictures with less after images when displaying motion pictures and less fuzzy images due to equalization without greatly reducing the response speed of the liquid crystal and the life time of the illumination unit.

What is claimed is:

1. A liquid crystal display apparatus comprising:

a pair of substrates, at least one of which is transparent;

a liquid crystal layer disposed between the pair of substrates;

a plurality of groups of electrodes disposed on at least one of the pair of substrates for applying an electric field to the liquid crystal layer;

a liquid crystal display part having a plurality of active elements connected to the electrodes;

a drive means, supplied with display data from a means for supplying display data, the drive means for driving individual pixels of the liquid crystal display part by applying a voltage corresponding to the display data to the individual pixels, the drive means including a data emphasis means for comparing new display data supplied for a current display frame from the means for supplying display data, with previous display data supplied for a previous display frame from the means for supplying display data, and for emphasizing the new display data to effect an overshot drive to drive the liquid crystal display portion so that a transmittance level exceeds a designated transmittance level within a first frame period and is maintained to exceed the designated transmittance level within a second frame period subsequent to the first frame period, in response to a difference detected between the previous display data and new display data as a result of the comparison;

an illumination panel unit divided into a plurality of illumination panel portions, with each illumination panel portion having a light source providing illumination to the liquid crystal display part; and an illumination control means, responsive to the overshot drive resulting in the transmittance level exceeding the designated transmittance level, for dynamically controlling an illumination start time and an illumination "on" time of the light source of individual said illumination panel portions, respectively, so that a time integral value of transmittance for an overshoot-frame, is equal to a time integral value of transmittance for a non-overshoot frame in which the transmission reaches and stays in a stable state at the designated transmittance level.

2. The liquid crystal display apparatus according to claim 1, wherein when said difference is detected in the display data by the comparison, the data emphasis means emphasizes and converts the new display data so as to increase the difference, and modifies a response of a corresponding pixel provided in the individual pixels of the liquid crystal display part so as to be larger than a value corresponding to an original value of the new display data; and wherein the illumination control means controls the illumination start time and the illumination "on" time of a corresponding one of light sources of the illumination panel portions of the illumination panel unit so that a time integral value of an amount of light passing through the corresponding pixel while a display characteristic is changing is equal to a time integral value of an amount of light passing through the corresponding pixel while the display characteristic is stable.

3. The liquid crystal display apparatus according to claim 1, wherein when said difference is detected in the display data by the comparison, the data emphasis means emphasizes and converts the new display data so as to increase the difference, and modifies a response of a corresponding pixel of the liquid crystal display part so as to be larger than a value corresponding to an original value of the new display data; and wherein the illumination control means controls the illumination start time and the illumination "on" time of a corresponding one of light sources of the illumination panel portions of the illumination panel unit so that visual sensation values with respect to light passing through the corresponding pixel in the course of response and after response are identical to each other.

4. The liquid crystal display apparatus according to claim 1, wherein the illumination start time and the illumination "on" time of light sources of the illumination panel portions of the illumination panel unit are made to be equal to average values of values for all the display data dependent on the individual display data according to the response of the liquid crystal display part after the emphasizing.

5. The liquid crystal display apparatus according to claim 2, wherein the illumination start time and the illumination "on" time of the light sources of the illumination panel portions of the illumination panel unit are made to be equal to average values of values for all the display data dependent on the individual display data according to the response of the liquid crystal display part after the emphasizing.

6. The liquid crystal display apparatus according to claim 3, wherein the illumination start time and the illumination "on" time of the light sources of the illumination panel portions of the illumination panel unit are made to be equal to average values of values for all the display data dependent on the individual display data according to the response of the liquid crystal display part after the emphasizing.

7. The liquid crystal display apparatus according to claim 1, wherein the illumination start time and the illumination "on" time of light sources of the illumination panel portions of the illumination panel unit are changed adaptively and determined so as to be average values weighted with a number of display data to be displayed at an area among values dependent on the individual display data according to the response of the liquid crystal display part after data emphasis and conversion.

8. The liquid crystal display apparatus according to claim 2, wherein the illumination start time and the illumination "on" time of the light sources of the illumination panel portions of the illumination panel unit are changed adaptively and determined so as to be average values weighted with a number of display data to be displayed at an area among values dependent on the individual display data according to the response of the liquid crystal display part after data emphasis and conversion.

9. The liquid crystal display apparatus according to claim 3, wherein the illumination start time and the illumination "on" time of light sources of the illumination panel portions of the illumination panel unit are changed adaptively and determined so as to be average values weighted with a number of display data to be displayed at an area among values dependent on the individual display data according to the response of the liquid crystal display part after data emphasis and conversion.

10. The liquid crystal display apparatus according to claim 1, wherein the light source includes a sheet-type light emitting element.

11. A liquid crystal display apparatus comprising:

a pair of substrates, at least one of which is transparent;

a liquid crystal layer disposed between the pair of substrates;

a plurality of groups of electrodes disposed on at least one of the pair of substrates for applying an electric field to the liquid crystal layer;

a liquid crystal display part having a plurality of active elements connected to the electrodes;

a drive means, supplied with display data from a means for supplying display data, the drive means for driving individual pixels of the liquid crystal display part by applying a voltage corresponding to the display data to the individual pixels, the drive means including a data emphasis means for comparing new display data supplied for a current display frame from the means for supplying display data, with previous display data supplied for a previous display frame from the means for supplying display data, and for emphasizing the new display data to effect an overshot drive to drive the liquid crystal display portion so that a transmittance level exceeds a designated transmittance level within a first frame period and is maintained to exceed the designated transmittance level within a second frame period subsequent to the first frame period, in response to a difference detected between the previous display data and new display data as a result of the comparison;

an illumination panel unit divided into a plurality of illumination panel portions, with each illumination panel portion having a light source providing illumination to the liquid crystal display part; and an illumination control means, responsive to the overshot drive resulting in the transmittance level exceeding the designated transmittance level, for dynamically controlling an illumination start time and an illumination "on" time of the light source of individual said illumination panel portions, respectively, so that a time integral value of transmittance for a time period occupied by the illumination "on" time in an overshoot-frame period is equal to a time integral value of transmittance for a time period occupied by the illumination "on" time in a frame period in which transmittance is in a stable state.

* * * * *